United States Patent [19]

Albes et al.

[11] 3,973,424

[45] Aug. 10, 1976

[54] PRODUCTION OF CORRUGATED TUBING

[75] Inventors: Friedrich Albes, Stadthagen; Werner Kleemann; Gerhard Ziemek, both of Hannover, all of Germany

[73] Assignee: Kabel-und Metallwerke Gutehoffnungshutte Aktiengesellschaft, Germany

[22] Filed: Jan. 9, 1975

[21] Appl. No.: 539,809

[30] Foreign Application Priority Data

Jan. 9, 1974 Germany ..... 2400842

[52] U.S. Cl. ..... 72/177; 72/367

[51] Int. Cl.[2] ..... B21D 15/00

[58] Field of Search ..... 72/130, 177, 367, 377; 29/477, 477.3, 477.7

[56] References Cited

UNITED STATES PATENTS

| | | | |
|---|---|---|---|
| 2,761,490 | 9/1956 | Walton | 72/177 |
| 2,987,798 | 6/1961 | Fromont | 29/1.31 |
| 3,269,005 | 8/1966 | Smith | 29/477.3 |

*Primary Examiner*—Lowell A. Larson
*Assistant Examiner*—Gene P. Crosby
*Attorney, Agent, or Firm*—Marn & Jangarathis

[57] ABSTRACT

Corrugated tubing is prepared by exerting axial pressure on the tubing being corrugated, without exerting any essential axial pressure, on the corrugating tool. Such pressure can be exerted by applying a braking force on the tubing exiting from the corrugator.

5 Claims, 2 Drawing Figures

PRODUCTION OF CORRUGATED TUBING

Figure 2:
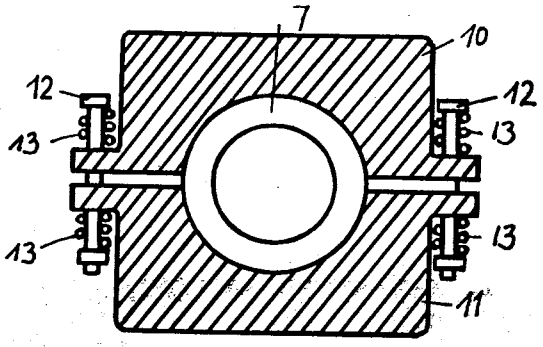

This invention relates to the production of corrugated tubing.

Corrugated tubing can be produced by variety of methods. In accordance with one method, a tube to be corrugated is fed through a stationary tool which is rotated to produce a helical corrugation. The inner diameter of the tool corresponds to the inner diameter of the helically corrugated tube.

In accordance with another method, as described in German laid open Pat. No. 1,086,314, tubing is continuously corrugated by a corrugating device comprised of an annular corrugating disc mounted in an eccentrically located corrugating head; i.e., the head is mounted eccentric to the tube axis and at a defined angle thereto.

An object of the present invention is to provide an improvement in such known techniques for corrugating tubing.

Another object of the present invention is to produce corrugated tubing in a single rotating step in a simple and economical manner.

A further object of the present invention is to produce corrugated tubing of high flexibility; i.e., deep corrugations in the order of one-half the tube wall thickness.

These and othr objects of the present invention should be apparent from reading the following description thereof.

In accordance with the present invention corrugated metal tubing is produced by effecting corrugation of the tubing while the tubing is under an axial longitudinal pressure.

More particularly, in accordance with the present invention, tubing is corrugated by one of the known corrugating devices; e.g., a helical corrugator as described in German laid open Pat. No. 1,086,314 or a corrugator as described for example in German laid open Pat. No. 1,916,357.

In accordance with the invention, the tube is corrugated under axial compressive pressure, without exerting any essential axial compressive pressure on the corrugating disc.

In accordance with the present invention, it is preferred to subject the tubing to an axial compressive force by exerting a braking force downstream of the corrugator. The braking force should be sufficient to exert a compressive force on the tubing by means of friction, without interrupting the continuity of movement of the tubing; i.e., the tubing is not subjected to "stick and slip" movement which would lead to an irregular corrugation.

In accordance with a particularly preferred embodiment, the braking force, to exert compressive axial pressure on the tubing, is provided by an annular tool, beyond the corrugator, in the direction of movement of the tubing. The annular tool is designed to correspond to the outer diameter of the tubing and exert a braking force, by friction, without interrupting te continuity of the movement of the tube. In other words, a compressive force is exerted on the tubing by the braking action, which slows the tubing, without interrupting movement thereof.

In accordance with a particularly preferred embodiment, the annular tool has a diameter which is capable of being changed to the various tube diameters, which are to be subjected to corrugation. To this end, it is preferred that the annular tube be formed of two mating pieces, which are compressed towards each other by springs. In this manner, the tool can be adjusted to the diameter of the pipe to be corrugated, and a substantially constant braking force can be exerted on the tubing passing therethrough. The tool is preferably formed of a resistant plastic material, such as polyethylene or a polyamide.

Figure 1:
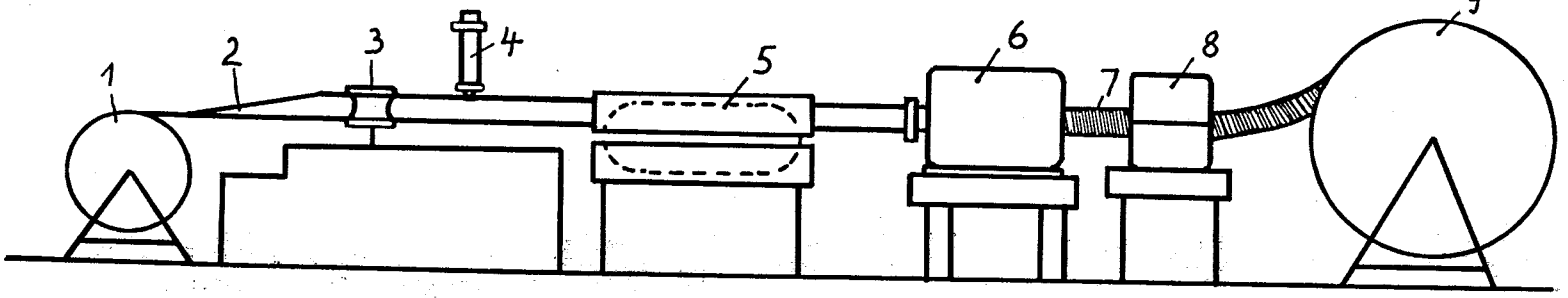

The invention will be further described with respect to an embodiment thereof illustrated in the drawings wherein:

FIG. 1 is a simplified schematic diagram of an apparatus for producing corrugated tubing; and FIG. 2 is a sectional view of an embodiment of a device for exerting a braking force in accordance with the invention.

Referring to FIG. 1, a metal strip 2 is drawn from a supply roller 1 between two circular pairs of knives (not shown) wherein the strip is cut to the desired size. The cut strip is formed into a slotted pipe by roller pair 3 and the edges of the strip are then welded together by a welding means 4, preferably an electric arc welding means. The welded smooth pipe is gripped by gripping means 5 and is fed to corrugating tool 6. The gripping means is preferably a tool as known from German Pat. No. 1,164,355. The corrugated pipe 7, which exits from corrugating tool 6, is fed through an annular tool 8 which exerts a braking force on the tubing without stopping movement thereof. As a result, of the slowing of movement of the tube by annular tool 8, the tube is subjected to a longitudinal axial pressure betwween gripping means 5 and annular tool 8. As hereinabove indicated, the feeding force of the gripping means 5 and the braking means 8 is coordinated to slow the movement of the tube, without interrupting movement thereof, while maintaining the corrugating tool essentially free from longitudinally acting forces. As a result of the axial pressure exerted on the tube, a deep corrugation can be rapidly provided by means of the corrugating tool 6.

The corrugated tube 7 is then rolled onto a drum 9, as known in the art.

As shown in FIG. 2, the annular tool 8 is comprised of the two parts 10 and 11 which are maintained in their position by bolts 12. Springs 13 provide a mating pressure force between parts 10 and 11, whereby the parts 10 and 11 are adjusted to the outer diameter of the corrugated pipe 7 and exert a braking force thereon.

Although the invention has been described with respect to a preferred embodiment of a tool for exerting an axial compressive force on the tubing being corrugated, it is to be understood that the invention is not limited to such an embodiment. The use of other means for exerting a braking force in order to exert an axial pressure on the tubing, without interrupting movement thereof, should be apparent from the teachings herein.

The present invention is particularly advantageous in that corrugated tubing having deep corrugations can be produced continuously and in unlimited lengths, in a facile manner.

Numerous modifications and variations of the present invention are possible in light of the above teachings and, therefore, within the scope of the appended claims, the invention may be practiced otherwise than as particularly described.

We claim

1. An apparatus for corrugating tubing, comprising:
a corrugating means for corrugating metal tubing;
a braking means for exerting a braking force on corrugated tubing exiting from the corrugating means to slow the movement of the corrugated tubing; and
a feeding means for feeding tubing to the corrugating means and braking means, whereby longitudinal axial force is applied to the tubing in the corrugating means between the feeding means and braking means.

2. The apparatus of claim 1 wherein the braking means is comprised of a tool including an aperture having a diameter corresponding to the outer diameter of the corrugated tubing, said corrugated tubing being passed through the aperture whereby a frictional braking force is applied to the corrugated tubing.

3. The apparatus of claim 2 wherein said tool is comprised of a pair of separate members defining the aperture therebetween and spring means connecting the pair of separate members to conform the aperture to the outer diameter of the corrugated tubing and exert a braking force on corrugated tubing passing through the aperture.

4. The apparatus of claim 3 wherein the pair of members are made of plastic.

5. A process for continuously producing corrugated metal tubing, comprising:
passing the tubing through a corrugating zone;
corrugating the tubing in the corrugating zone; and
exerting an axial longitudinal compressive force on said tubing during said corrugating, said axial longitudinal compressive force being exerted on the tubing without exerting a longitudinal force on the corrugating tool in the corrugating zone by slowing movement of the tubing withdrawn from the corrugation zone by application of braking force to the tubing.

* * * * *